US009233562B2

(12) United States Patent
Sago et al.

(10) Patent No.: US 9,233,562 B2
(45) Date of Patent: Jan. 12, 2016

(54) PRINTER WITH ROTARY CUTTER INCLUDING TAPE GUIDE ON ROTARY BLADE

(71) Applicants: Akira Sago, Nagoya (JP); Nobuo Kato, Nagoya (JP)

(72) Inventors: Akira Sago, Nagoya (JP); Nobuo Kato, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/154,222

(22) Filed: Jan. 14, 2014

(65) Prior Publication Data

US 2014/0126947 A1 May 8, 2014

Related U.S. Application Data

(63) Continuation-in-part of application No. PCT/JP2012/067562, filed on Jul. 10, 2012.

(30) Foreign Application Priority Data

Jul. 14, 2011 (JP) ..... 2011-155886

(51) Int. Cl.
*B41J 11/70* (2006.01)
*B26D 1/38* (2006.01)

(52) U.S. Cl.
CPC ..... *B41J 11/70* (2013.01); *B26D 1/385* (2013.01); *B41J 11/703* (2013.01)

(58) Field of Classification Search
CPC ..... B26D 1/385; B41J 11/70; B41J 11/66; B41J 11/703
See application file for complete search history.

(56) References Cited

U.S. PATENT DOCUMENTS

| | | | | | |
|---|---|---|---|---|---|
| 4,114,491 | A * | 9/1978 | Hashimoto et al. | ..... | 83/341 |
| 5,690,009 | A * | 11/1997 | Nakao et al. | ..... | 83/76.8 |
| 2012/0053730 | A1 * | 3/2012 | Nagatsu | ..... | 700/275 |

FOREIGN PATENT DOCUMENTS

| | | | | | |
|---|---|---|---|---|---|
| GB | 245261 | A * | 1/1926 | | |
| JP | 58223599 | | 12/1983 | | |
| JP | 601997 | | 1/1985 | | |
| JP | 05337885 | | 12/1993 | | |
| JP | 09168995 | A * | 6/1997 | ..... | B26D 1/38 |
| JP | 2001096492 | A * | 4/2001 | ..... | B26D 5/30 |

(Continued)

OTHER PUBLICATIONS

International Search Report issued in Application No. PCT/JP2012/067562 on Jan. 23, 2014.

(Continued)

*Primary Examiner* — Daniel J Colilla
(74) *Attorney, Agent, or Firm* — McCarter & English, LLP

(57) ABSTRACT

A rotary cutter apparatus comprises a rotary body and a holding body. The rotary body is supported by a housing so as to rotate along a rotating direction. The holding body is supported by the housing. The rotary body has a rotary blade including a first edge portion. The holding body has a fixed blade including a second edge portion. The first edge portion is configured to be in contact with the second edge portion and to be rubbed with the second edge portion. The first edge portion and the second edge portion are configured to perform cutting of an object to be cut. The object is located in an introduction path. The rotary cutter apparatus further comprises a guide member configured to be in contact with the object and to guide it when the object is fed to an inside of a rotation trajectory of the rotary body.

8 Claims, 13 Drawing Sheets

(56) References Cited

FOREIGN PATENT DOCUMENTS

| | | |
|---|---|---|
| JP | 2009148875 | 7/2009 |
| JP | 2011098419 | 5/2011 |

OTHER PUBLICATIONS

International Search Report for PCT/JP2012/067562, mailed on Aug. 21, 2012.

* cited by examiner

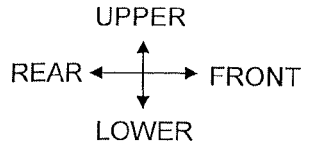
FIG. 12A
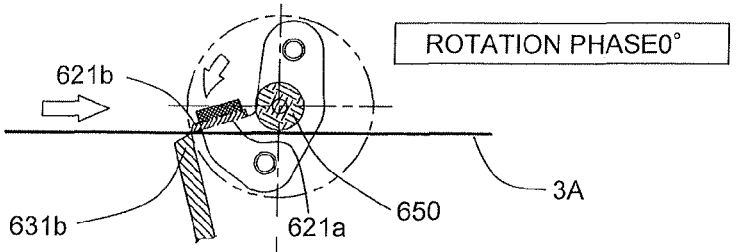
FIG. 12B
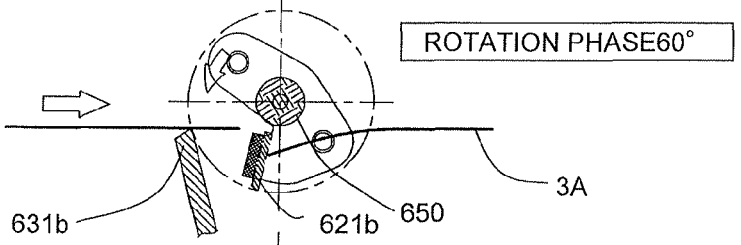
FIG. 12C
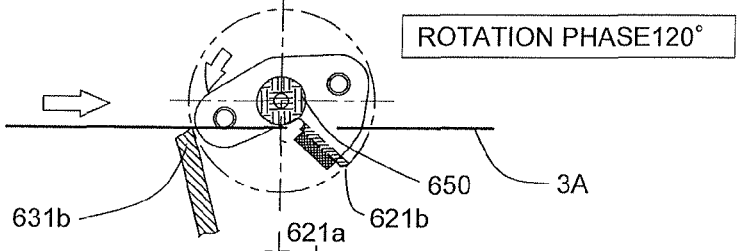
FIG. 12D
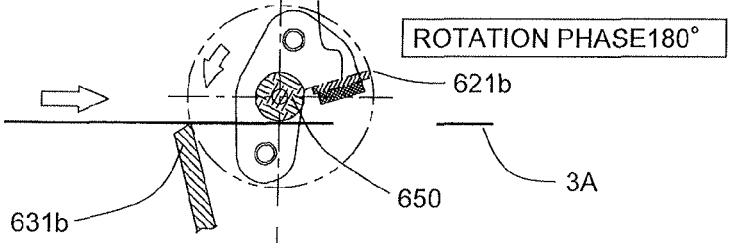
FIG. 12E
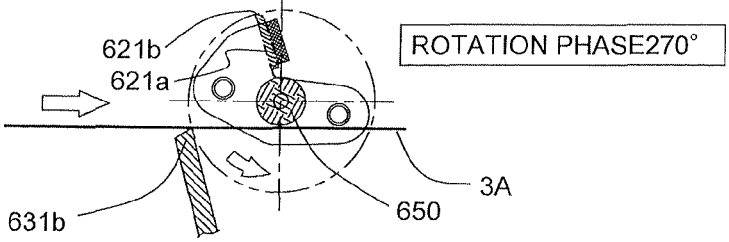

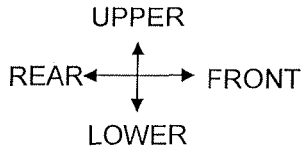
FIG. 14A
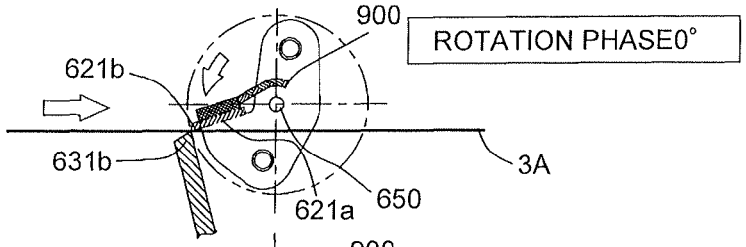
FIG. 14B
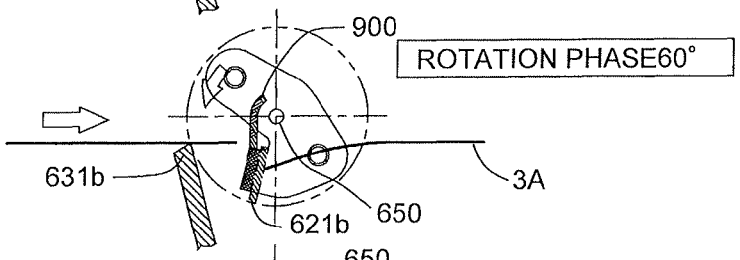
FIG. 14C
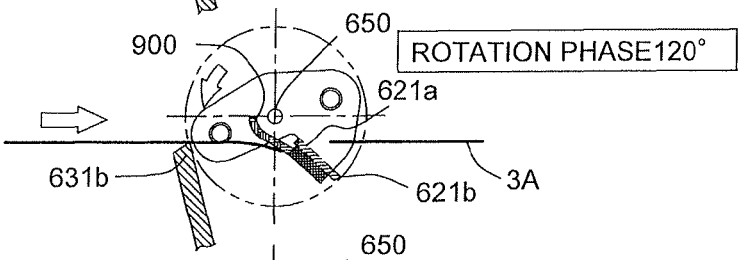
FIG. 14D
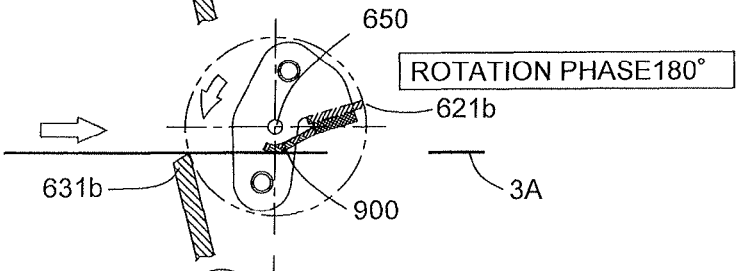
FIG. 14E
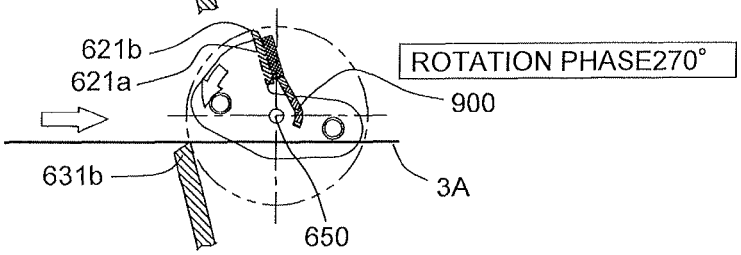

PRINTER WITH ROTARY CUTTER INCLUDING TAPE GUIDE ON ROTARY BLADE

CROSS-REFERENCE TO RELATED APPLICATION

This is a CIP application PCT/JP2012/067562, filed Jul. 10, 2012, which was not published under PCT article 21(2) in English.

BACKGROUND

1. Field

The present disclosure relates to a rotary cutter apparatus for cutting an object to be cut and a printer using the rotary cutter apparatus.

2. Description of the Related Art

A rotary cutter apparatus which can cut the object to be cut which is being fed without stopping the feeding is already known. In this prior-art rotary cutter apparatus, a spiral-shaped blade is provided on an outer periphery of a cylindrical body portion, and by making each part of the blade sequentially cut into the object to be cut, the object to be cut is cut linearly.

In the aforementioned prior art, when the object to be cut is fed from a cutting position to the inside of a rotary body in an introduction path, means for guiding the object to be cut is not particularly provided. As a result, there is a concern that the introduced object to be cut erroneously advances toward the rotary blade and collides against or interferes with an edge of the rotary blade. In such a case, the object to be cut cannot be stably cut.

SUMMARY

The present disclosure has an object to provide a rotary cutter apparatus and a printer which can stably cut the object to be cut.

In order to achieve the above-described object, according to the aspect of the present application, there is provided a rotary cutter apparatus comprising a housing, a rotary body supported by the housing so as to rotate along a predetermined rotating direction around a rotation axis, and a holding body supported by the housing, the rotary body having a rotary blade including a first edge portion, the holding body having a fixed blade including a second edge portion, the first edge portion being configured to be in contact with the second edge portion from a first side in the rotating direction and to be rubbed with the second edge portion, the first edge portion and the second edge portion being configured to perform cutting of an object to be cut by the rubbing, the object being located in an introduction path passing in a vicinity of an end portion of the second edge portion, and the rotary cutter apparatus further comprising a guide member configured to be in contact with the object to be cut from the first side in the rotating direction and to guide the object to a second side in the rotating direction when the object is fed from a cutting position to an inside of a rotation trajectory of the rotary body in the introduction path.

The rotary cutter apparatus of the present disclosure has the rotary body provided with the rotary blade and the holding body provided with the fixed blade. By means of rotation of the rotary body along a predetermined rotating direction, the first edge portion of the rotary blade gets closer to the second edge portion from the first side along the rotating direction and rubs itself with the second edge portion. As a result, the object to be cut having been fed and introduced to the introduction path passing in the vicinity of the second edge portion can be cut by the first edge portion and the second edge portion in collaboration.

In the present disclosure, a guide member is provided. As described above, the first edge portion of the rotary blade rotates along the rotating direction from the first side to the second side and is brought into contact with the second edge portion from the first side. In response to that, the guide member is brought into contact with the object to be cut which has been fed to the introduction path from the first side and guides the object to be cut to the second side opposite thereto. That is, erroneous advance of the introduced object to be cut to the first edge portion side of the rotary blade and collision against or interference with the first edge portion before getting closer to the second edge portion can be prevented. As a result, the object to be cut can be stably cut when the first edge portion and the second edge portion rub each other.

BRIEF DESCRIPTION OF THE DRAWING

FIG. 12A is a conceptual side view illustrating a guide behavior of the label tape executed with progress of rotation of the rotary body.

FIG. 12B is a conceptual side view illustrating a guide behavior of the label tape executed with progress of rotation of the rotary body.

FIG. 12C is a conceptual side view illustrating a guide behavior of the label tape executed with progress of rotation of the rotary body.

FIG. 12D is a conceptual side view illustrating a guide behavior of the label tape executed with progress of rotation of the rotary body.

FIG. 12E is a conceptual side view illustrating a guide behavior of the label tape executed with progress of rotation of the rotary body.

FIG. 14A is a conceptual side view illustrating an example of the guide behavior of the label tape executed with progress of rotation of the rotary body.

FIG. 14B is a conceptual side view illustrating an example of the guide behavior of the label tape executed with progress of rotation of the rotary body.

FIG. 14C is a conceptual side view illustrating an example of the guide behavior of the label tape executed with progress of rotation of the rotary body.

FIG. 14D is a conceptual side view illustrating an example of the guide behavior of the label tape executed with progress of rotation of the rotary body.

FIG. 14E is a conceptual side view illustrating an example of the guide behavior of the label tape executed with progress of rotation of the rotary body.

DETAILED DESCRIPTION OF THE PREFERRED EMBODIMENTS

An embodiment of the present disclosure will be described below by referring to the attached drawings. The present embodiment is an embodiment if a rotary cutter apparatus of the present disclosure is applied to a label producing apparatus. In the explanation below, a vertical direction, a longitudinal direction, and a lateral direction correspond to arrow directions indicated as appropriate in each figure.

Figure 1:
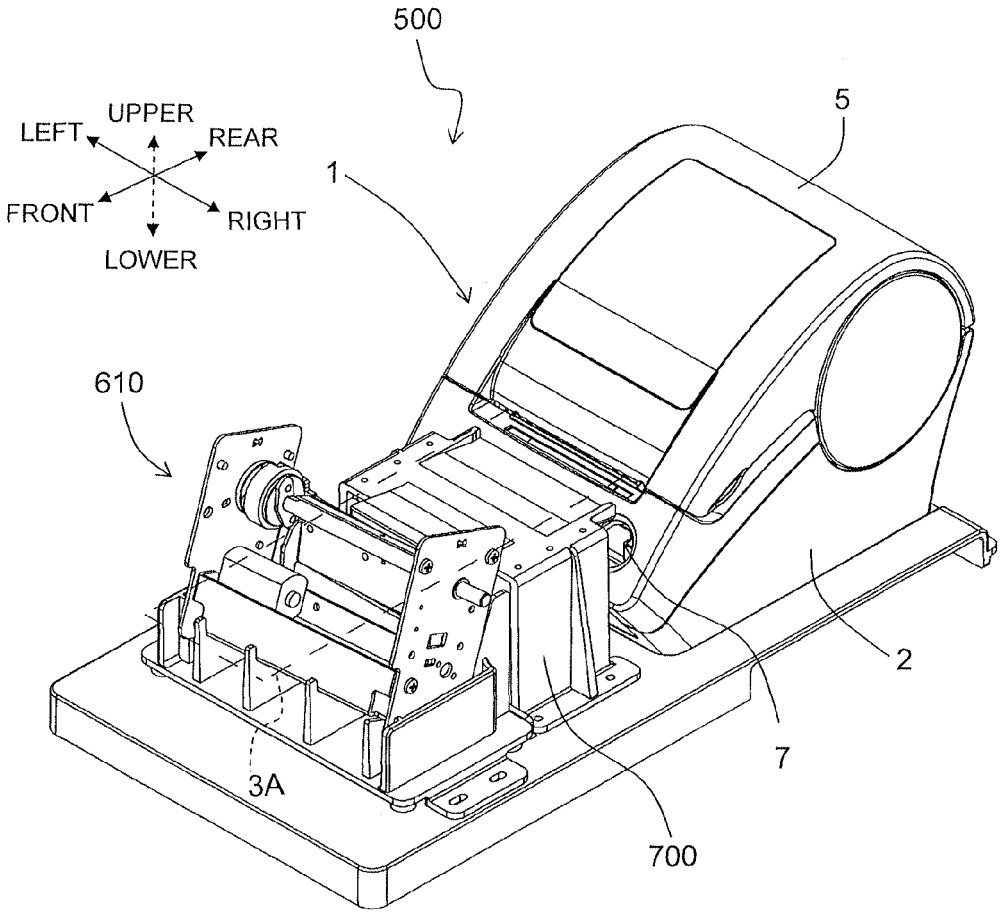
FIG. 1 is a perspective view illustrating an outline configuration of a label producing apparatus provided with a rotary cutter apparatus according to an embodiment of the present disclosure.

As illustrated in FIG. 1, the label producing apparatus 500 is provided with a label producing apparatus body 1 and a rotary cutter apparatus 610.

<Configuration of Label Producing Apparatus Body>

First, a configuration of the label producing apparatus body 1 will be explained by using FIGS. 1, 2, 3A, and 3B. The label producing apparatus body 1 includes a housing 2, an upper cover 5 made of a transparent resin, a power button 7 arranged on a front side of the housing 2, and the like.

Figure 3A:
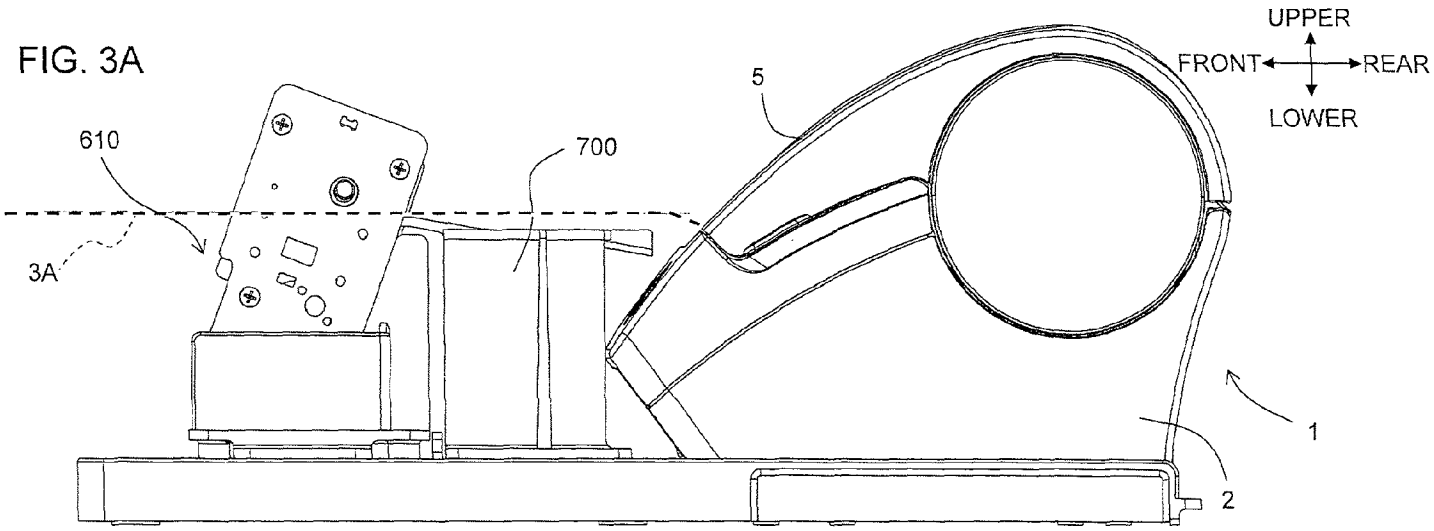
FIG. 3A is a side view of the label producing apparatus illustrated in FIG. 1.
Figure 3B:
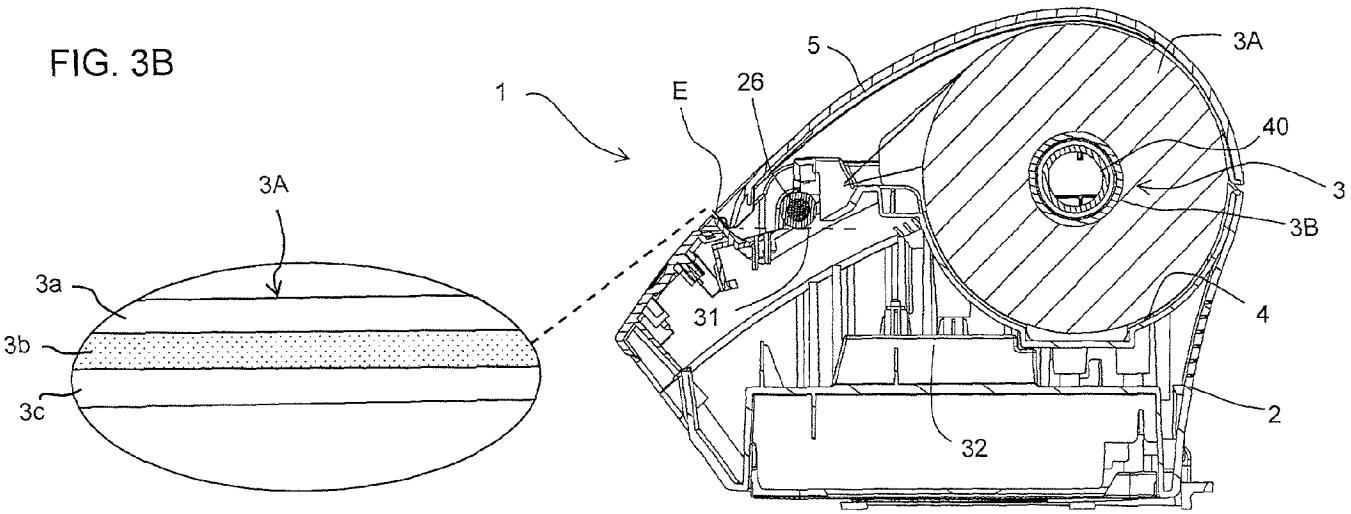
FIG. 3B is a sectional view of the label producing apparatus illustrated in FIG. 1.

As illustrated in FIG. 3B, a tape holder 3 is accommodated and arranged in a tape holder accommodating portion 4 arranged in the label producing apparatus body 1. Moreover, the upper cover 5 is mounted capable of being opened/closed on an upper end edge portion on a rear side so as to cover an upper side of the tape holder accommodating portion 4.

A label tape 3A having a predetermined width is rotatably wound around a tape holder 3. That is, the label tape 3A is wound in a roll state around a winding core 3B having a predetermined outer peripheral diameter and constitutes a tape roll. On an inner peripheral side of the winding core 3B, a holder shaft member 40 having a substantially cylindrical shape is disposed so as to be arranged in an axial direction.

The label tape 3A has a three-layer structure in this example (See a partially enlarged view), and a separation sheet 3*a*, an adhesive layer 3*b*, and a lengthy thermal paper 3*c* having a self-coloring property are laminated and constituted in this order from a side (upper side in FIG. 3B) to be wound around the outer side of the roll toward the side opposite to that (lower side in FIG. 3B). On the back side of the thermal paper 3*c* (upper side in FIG. 3B, the separation sheet 3*a* is bonded by the adhesive layer 3*b*. When a finally completed print label T is to be bonded to a predetermined article or the like, this separation sheet 3*a* enables adhesion by the adhesive layer 3*b* to the article or the like by separating this.

Moreover, on a downstream side in a feeding direction of a feeding-out position from the tape roll of the label tape 3A, a thermal head 31 for applying a desired print is disposed, and a platen roller 26 is arranged at a position facing this thermal head 31. The platen roller 26 feeds out the label tape 3A wound around the winding core 3B and feeds it on the feeding path reaching a discharging exit E.

The thermal head 31 is moved downward by rotationally moving a lever (not shown) upward for vertical operation thereof into a state away from the platen roller 26 and is moved upward by rotationally moving the lever downward into a printable state by pressing and urging the label tape 3A onto the platen roller 26. By rotating and driving the platen roller 26 by a pulse motor (or a stepping motor) or the like while the thermal head 31 is driven and controlled, the desired print is applied to a print area (not shown) provided on the label tape 3A while the label tape 3A is being fed. Subsequently, the label tape 3A with print is discharged out of the discharging exit E and then, cut to a desired length by the rotary cutter apparatus 610 which will be described later, and whereby the print label T (See FIGS. 4A and 4B which will be described later) is produced. Broken lines in FIGS. 1, 3A, and 3B indicate the feeding path of the label tape 3A being fed.

On the front side of the label producing apparatus body 1 (downstream side in the feeding direction from the discharging exit E), a guide placing base 700 is installed. Further on the downstream side in the feeding direction from this guide placing base 700, the rotary cutter apparatus 610 is arranged. The guide placing base 700 leads the label tape 3A with print discharged out of the discharging exit E to a space between a first flat blade 621 (which will be described later) and a second flat blade 631 (which will be described later) of the rotary cutter apparatus 610.

Figure 4A:
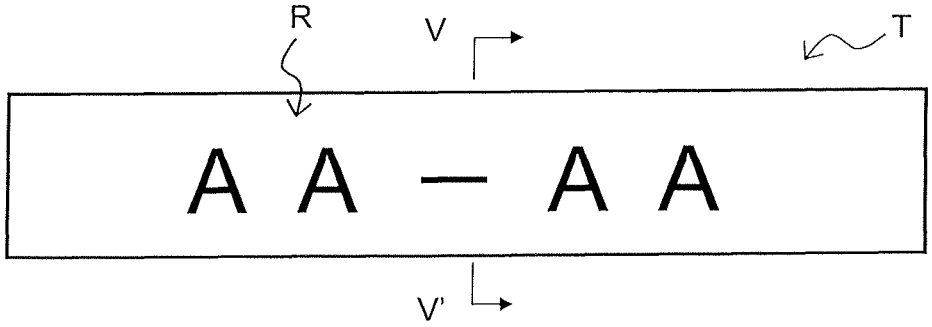
FIG. 4A is a top view illustrating an example of an appearance of a print label.
Figure 4B:
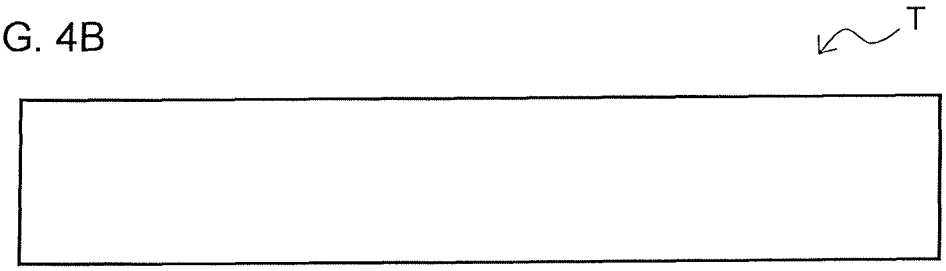
FIG. 4B is a bottom view illustrating an example of an appearance of a print label.
Figure 5:
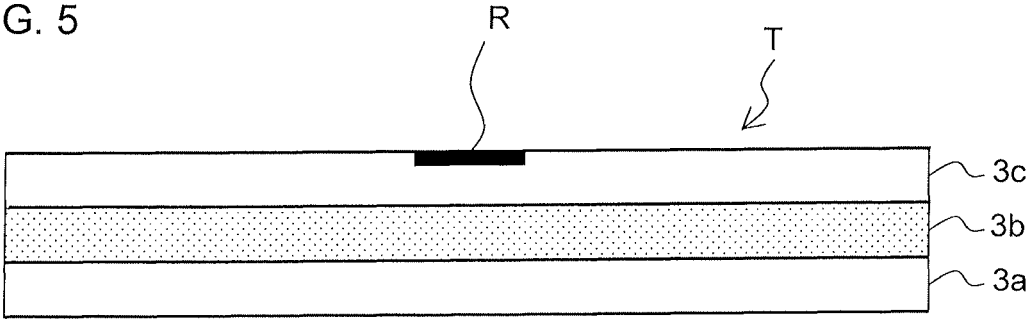
FIG. 5 is a cross sectional view by a V-V' section in FIG. 4A.
Figure 6:
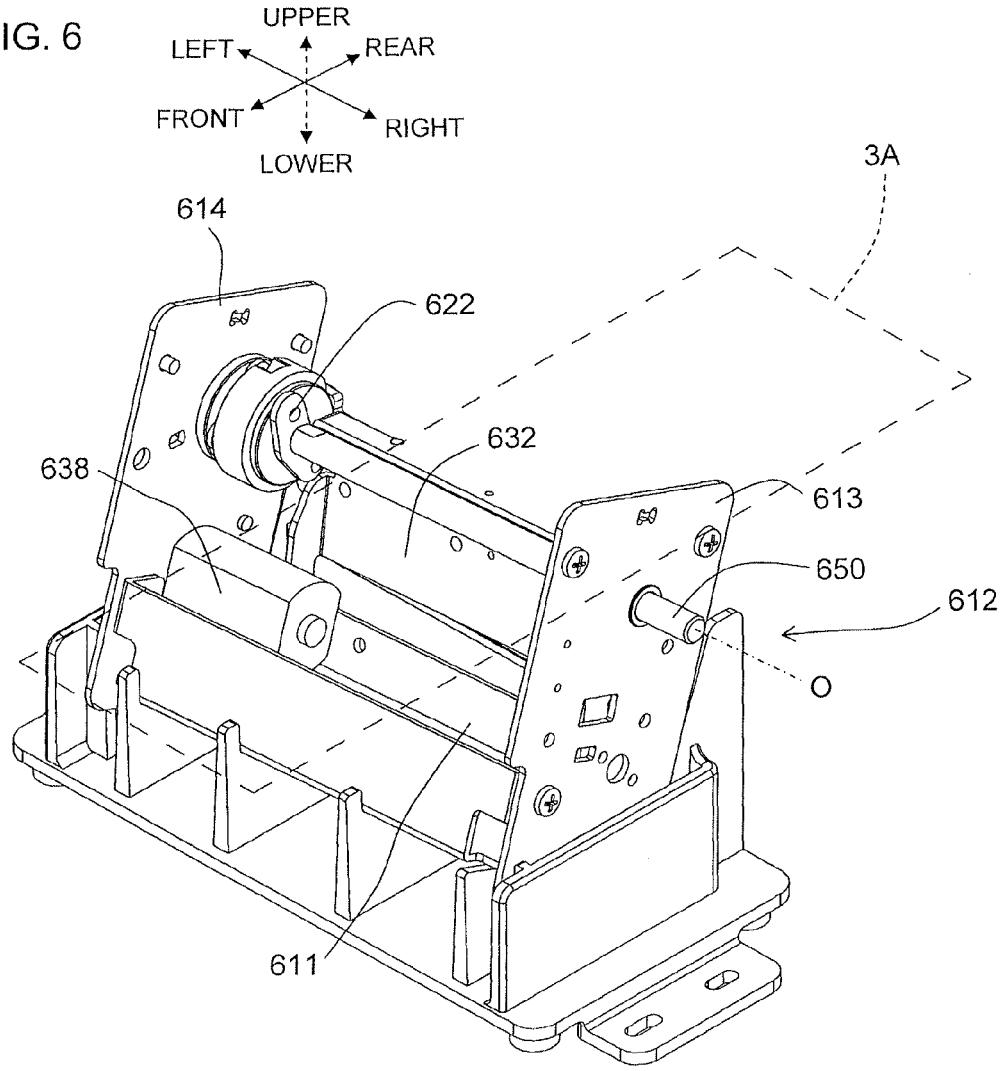
FIG. 6 is a perspective view of the rotary cutter apparatus when seen from diagonally above on a front side.

The print label T formed by completing cutting of the label tape 3A by the rotary cutter apparatus 610 is illustrated in FIGS. 4A, 4B, and 5. As illustrated, the print label T has the aforementioned three-layer structure, and the thermal paper 3*c*, the adhesive layer 3*b*, and the separation sheet 3*a* are laminated in this order from the front surface side (upper side in FIG. 5) to the side opposite thereto (lower side in FIG. 5). Further, a print R (in this example, characters "AA-AA") is printed on the surface of the thermal paper 3*c* as described above.

<Outline Configuration of Rotary Cutter Apparatus>

Subsequently, the rotary cutter apparatus which is an essential part of the present embodiment will be described by using FIGS. 6 to 10B. As illustrated in FIGS. 6, 7A, 7B, 8A, 8B, 9A, 9B, and 10A, 10B, the rotary cutter apparatus 610 is provided with a housing 612, a rotary body 620, and a holding body 630. The rotary cutter apparatus 610 performs linear cutting on the label tape 3A having a print formed by the thermal head 31 using the first flat blade 621 and the second flat blade 631 in collaboration. The housing 612 has a first wall surface 613 on one side (right side in this example) and a second wall surface 614 on the other side (left side in this example). The housing 612 is provided with a connection portion 611 connecting the first wall surface 613 and the second wall surface 614 to each other.

Figure 2:
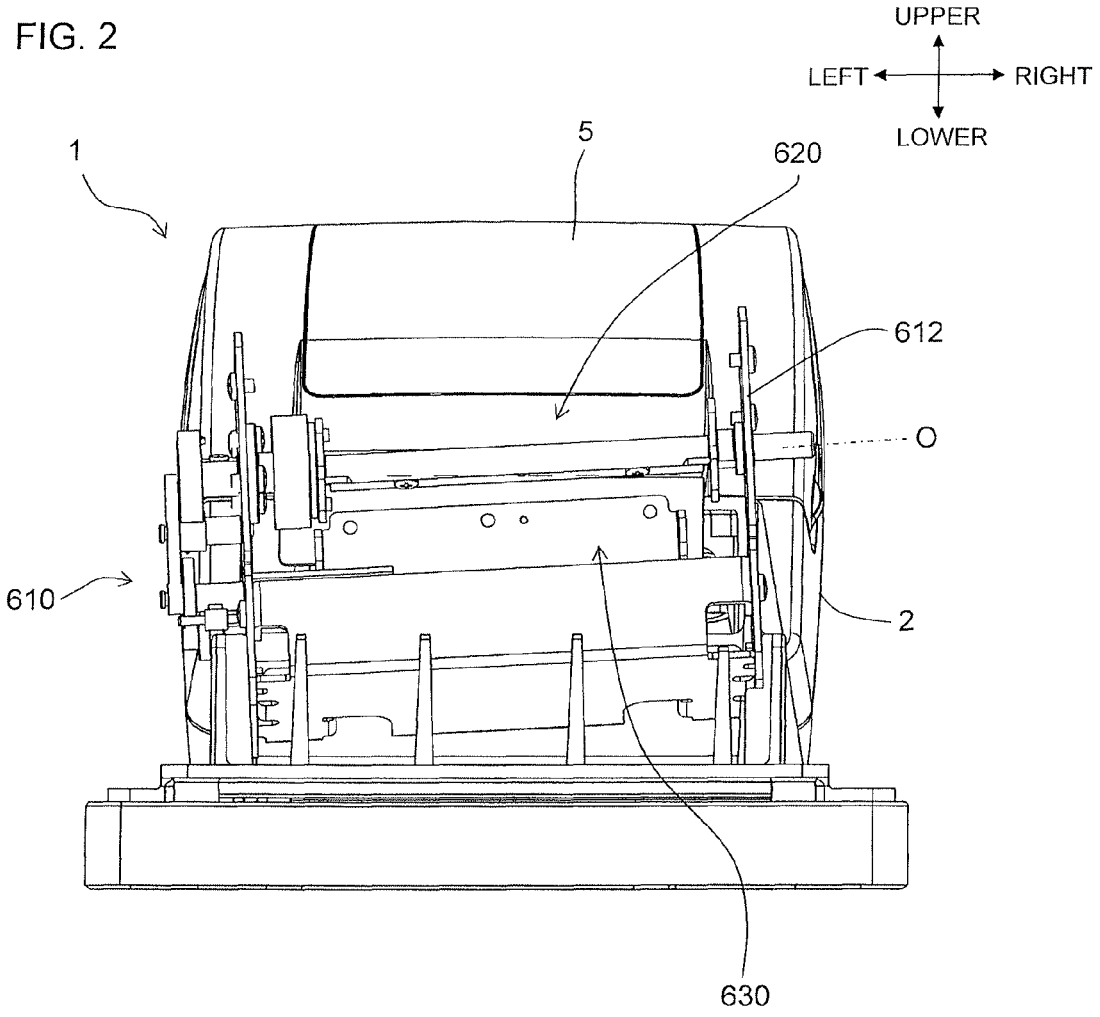
FIG. 2 is a front view of the label producing apparatus illustrated in FIG. 1.

As illustrated in FIGS. 1 and 2, the rotary cutter apparatus 610 is arranged in a posture that planar directions of the first wall surface 613 and the second wall surface 614 of the housing 612 are inclined slightly to the left side from a vertical direction, but for convenience of explanation and ease to see the illustration, illustration is made in a posture that the housing 612 is returned to the vertical direction in FIGS. 7A, 7B, 8A, 8B, 10A and 10B.

<Configuration of Rotary Body>

The rotary body 620 is provided with a first bracket 622 on one side, a second bracket 623 on the other side, a rotary shaft 650 disposed on the housing 612 so as to connect the first bracket 622 and the second bracket 623 to each other and rotatably around a rotation axis O, and a flat blade mounting portion 624 disposed on the rotary shaft 650 and mounted with the first flat blade 621.

Figure 7A:
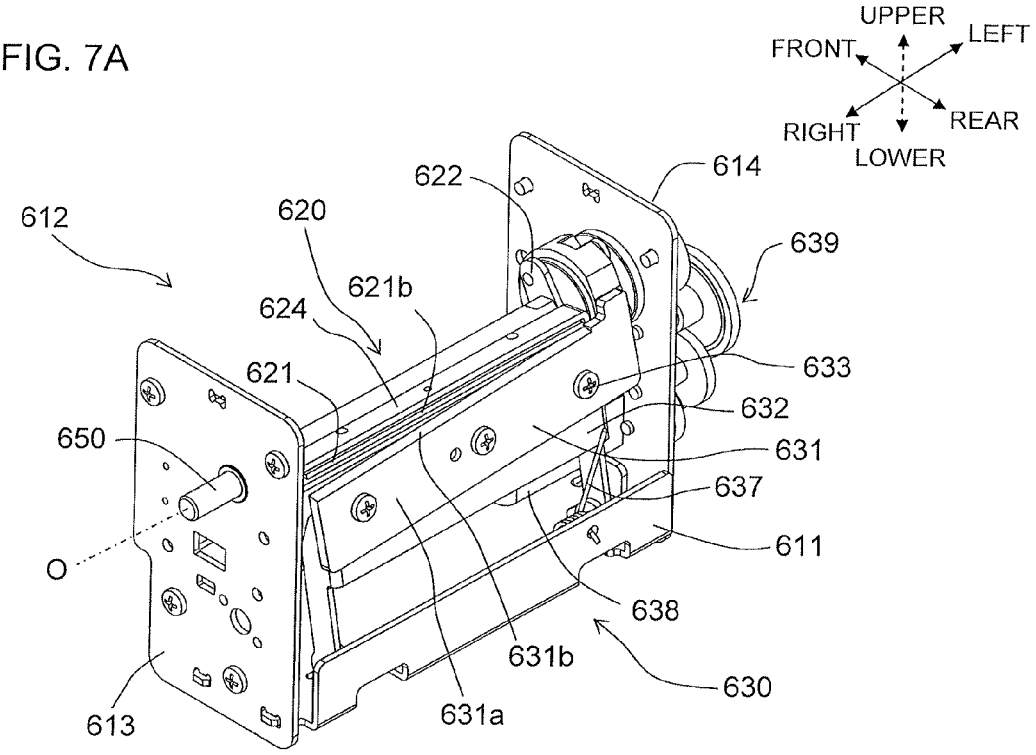
FIG. 7A is a perspective view of the rotary cutter apparatus when seen from diagonally above on a rear side.
Figure 8A:
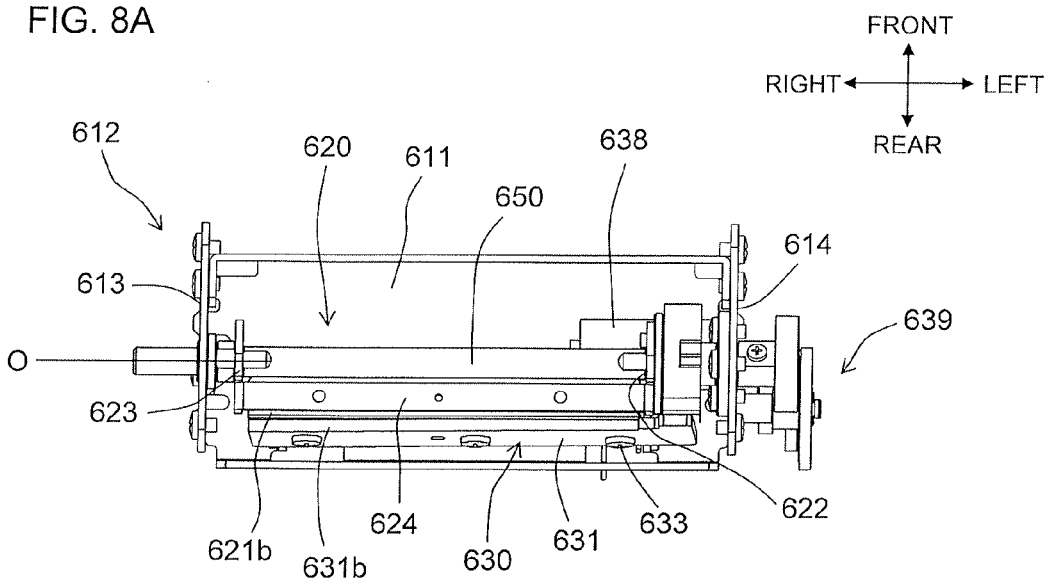
FIG. 8A is a plan view of the rotary cutter apparatus.
Figure 8B:
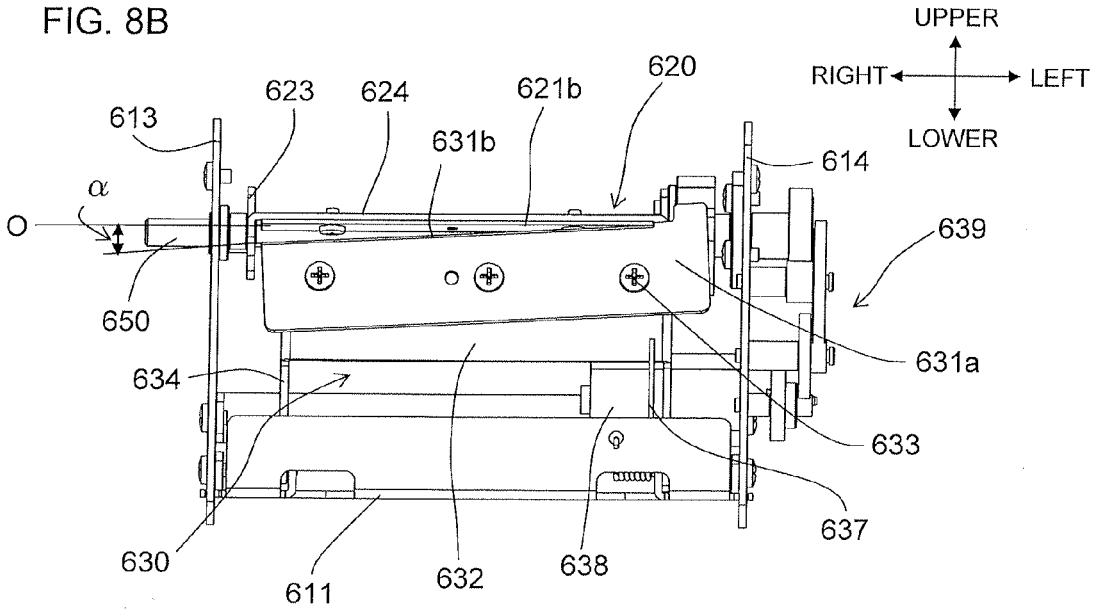
FIG. 8B is a rear view of the rotary cutter apparatus.

The first flat blade 621 is provided with a substantially plate-shaped first base portion 621*a* (See FIGS. 12A to 12E and 14A to 14E) and a first edge portion 621*b* (See FIG. 10A) extending linearly to an edge portion of this base portion 621*a*. At this time, the first edge portion 621*b* is, as illustrated in FIGS. 7A, 8B and the like, supported by the flat blade mounting portion 624 and the rotary shaft 650 so as to be in parallel with the rotation axis O. When the rotary body 620 is rotated, the first edge portion 621*b* draws a cylindrical rotation trajectory (not shown) around the rotation axis O.

<Configuration of Holding Body>

The holding body 630 has a plate-shaped holding portion 632 provided with the second flat blade 631. The holding portion 632 is also provided with extended portions 634 and 634 on both left and right end portions and is supported by a swing support mechanism 635 (See FIG. 7B), capable of swing with respect to the housing 612 through these extended portions 634 and 634.

Figure 7B:
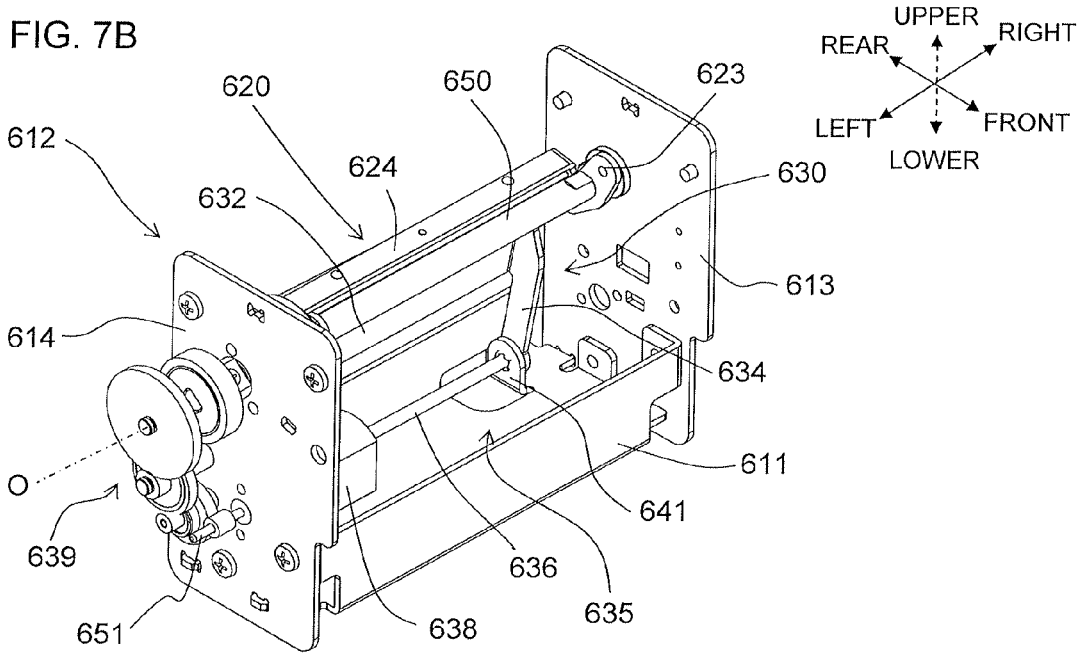
FIG. 7B is a perspective view of the rotary cutter apparatus when seen from diagonally above on the front side.

The swing support mechanism 635 is, as illustrated in FIGS. 7A and 7B, provided with a pair of left and right hinge arms 641 and 641 installed upright on the connection portion 611 of the housing 612, a support shaft 636 which is inserted capable of rotational movement through these hinge arms 641 and 641 and to the both ends of which the extended portions 634 of the holding portion 632 are fixed, and a coil-shaped coil spring 637 arranged around the support shaft 636. The holding portion 632 is made capable of swing fore and aft with respect to the housing 612 since the support shaft 636 fixed to the extended portions 634, 634 is supported capable of rotational movement by the hinge arms 641. At this time, as illustrated in FIG. 7A, one end of the coil spring 637 (rear end) is fixed to the connection portion 611, while the other end (upper end) of the coil spring 637 is brought into contact with a rear part of the holding portion 632, and as a result, the coil spring 637 urges the holding portion 632 to a front (in other words, in a direction toward the rotary body 620). As a result, the holding portion 632 is supported capable of swing with respect to the housing 612 so as to be able to approach to/leave from a rotation trajectory (not shown) of the entire rotary body 620.

The second flat blade 631 is provided with a substantially plate-shaped second base portion 631*a* and a second edge portion 631*b* extending linearly in an edge portion of this second base portion 631*a*. The second flat blade 631 is held by the holding portion 632 by fixation of the second base portion 631*a* with a mounting screw 633. At this time, the holding portion 632 is arranged capable of swing as above, but in any swing state, the holding portion 632 holds the second flat blade 631 so that the second edge portion 631*b* of the second flat blade 631 is not in parallel (a position of twist) with respect to the rotation axis O. In detail, in any swing state of the holding portion 632, a planar direction of the second base portion 631*a* of the second flat blade 631 (that is, a mounting surface direction of the second flat blade 631) becomes parallel with the rotation axis O at a predetermined interval (See FIGS. 8A and 8B). Moreover, in any swing state of the holding portion 632, the second flat blade 631 is arranged with a predetermined angle $\alpha$ formed between a straight line including the second edge portion 631*b* and the rotation axis O, as illustrated in FIG. 8B, when seen from the front (in other words, from a side surface direction orthogonal to the planar direction of the second base portion 631*a*). Since the rotation axis O and the first edge portion 621*b* are in parallel with each other all the time, an inclination angle (so-called shearing angle) when the first edge portion 621*b* and the second edge portion 631*b* are in contact accords with this angle $\alpha$. Particularly, the second edge portion 631*b* is held so as to extend linearly in a feeding surface of the label tape 3A during a cutting operation.

As the result of the above, the first flat blade 621 is supported by the flat blade mounting portion 624 so that a cylindrical first rotation trajectory drawn by the first edge portion 621*b* when the rotary body 620 rotates is brought into contact with the second edge portion 631*b*, and the second flat blade 631 is held by the holding portion 632. As a result, such a positional relationship is obtained that the second edge portion 631*b* of the second flat blade 631 is oblique to an outer edge line of the cylindrical first rotation trajectory around the rotation axis O.

Figure 9A:
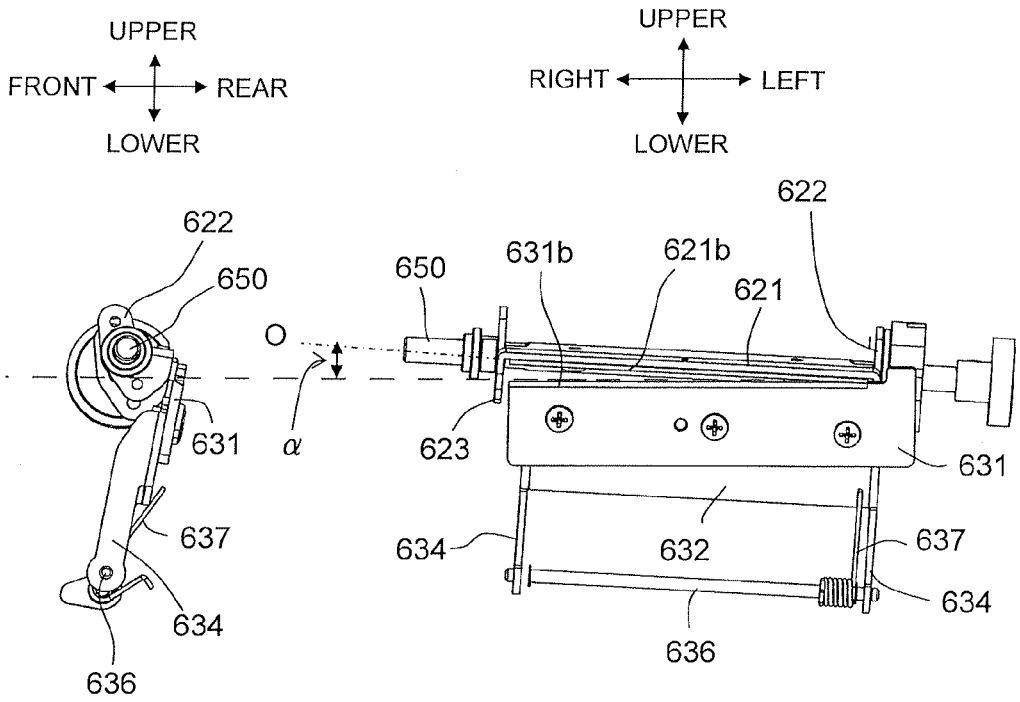
FIG. 9A is a rear view and a side view illustrating a constitution of an essential part of the embodiment of the present disclosure in which a rotation axis of a rotary body is arranged diagonally with respect to a horizontal holding body.
Figure 9B:
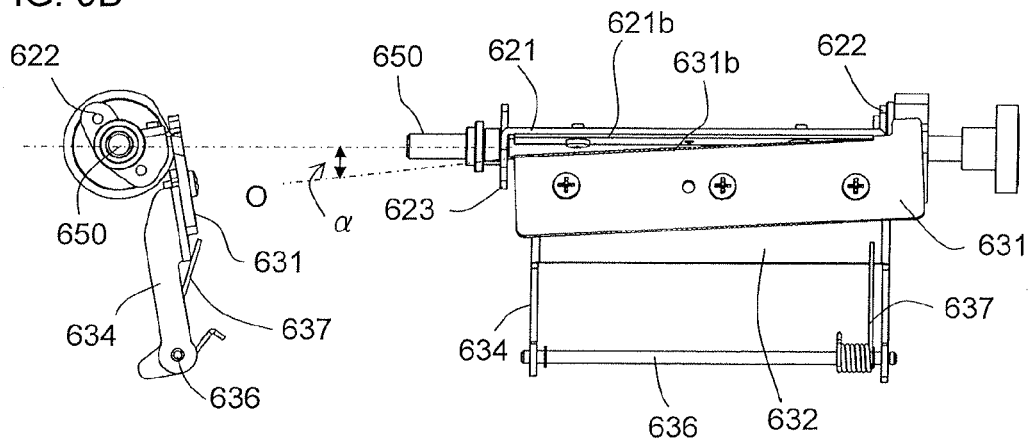
FIG. 9B is a rear view and a side view illustrating a variation in which the holding body is arranged diagonally with respect to the rotation axis of the horizontal rotary body.
Figure 10A:
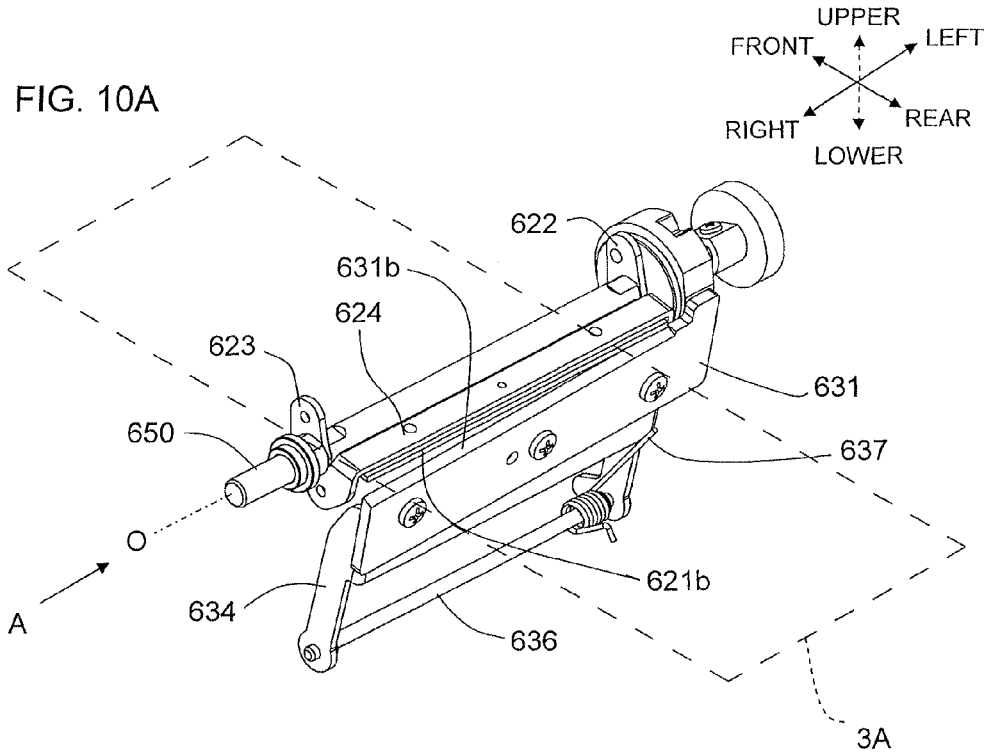
FIG. 10A is a perspective view of an essential part of the rotary cutter apparatus illustrating an introduction mode of a label tape into a space between the rotary body and the holding body.
Figure 10B:
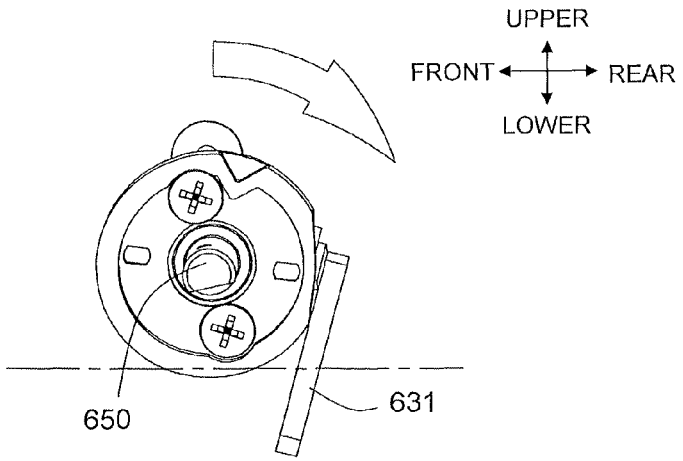
FIG. 10B is a conceptual side view when seen from an A direction in FIG. 10A, illustrating an introduction mode of a label tape into a space between the rotary body and the holding body.

In the present embodiment, as illustrated in FIG. 9A, the rotary body 620 and the holding body 630 are arranged so that the feeding path of the label tape 3A (in other words, the second edge portion 631*b*) becomes horizontal when seen from the front side, and the rotation axis O of the rotary body 620 is inclined with respect to the horizontal direction, but this is not limiting. That is, as illustrated in FIG. 9B, the rotary body 620 and the holding body 630 may be arranged so that the rotation axis O of the rotary body 620 becomes horizontal and the feeding path of the label tape 3A (in other words, the second edge portion 631*b*) is inclined with respect to the horizontal direction when seen from the front side.

<Transmission of Driving Force>

On the other hand, below the second wall surface 614 side of the housing 612, a motor 638 configured to drive the rotary body 620 is disposed. In response to that, on an outer surface of the second wall surface 614, a driving transmission mechanism 639 composed of a gear train capable of operationally connecting a driving shaft 651 of the motor 638 penetrating the second wall surface 614 (See FIG. 7B) and the rotary shaft 650 of the rotary body 620 penetrating the second wall surface 614 to each other is provided. The motor 638 rotates the rotary body 620 through the driving transmission mechanism 639 in a direction in which the first edge portion 621*b* of the first flat blade 621 gets closer to the second edge portion 631*b* of the second flat blade 631 (See FIG. 10B). As a result, the label tape 3A inserted into a space between the rotary body 620 and the holding body 630 is cut in a running state (without stopping feeding).

<Cutting Operation>

An operation of the rotary cutter apparatus 610 will be described by using FIGS. 11A to 11E. As described above, in the present embodiment, the positional relationship is obtained that the second edge portion 631*b* of the second flat blade 631 is oblique to the outer edge line of the cylindrical rotation trajectory around the rotation axis O drawn by the first edge portion 621*b* when the rotary body 620 rotates. As a result, after the first edge portion 621*b* rotating on the rotation trajectory gets closer to the second edge portion 631*b* first at one end portion (a left end portion in this example) in the linear shape, a portion getting closer to the second edge portion 631*b* gradually moves linearly from the left end portion to the right side with progress of the rotation. FIGS. 11A to 11E sequentially illustrate the behavior at this time.

Figure 11A:
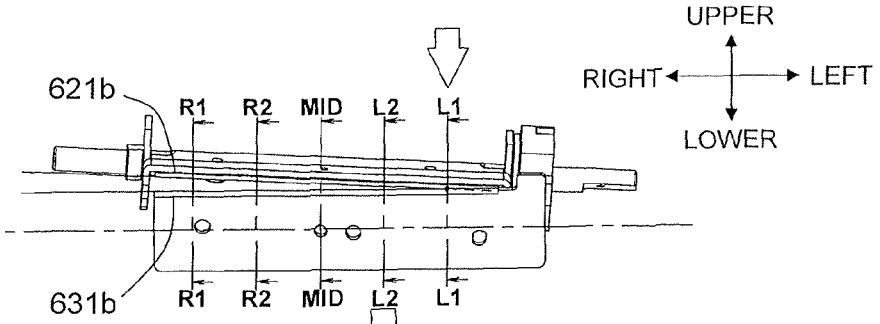
FIG. 11A is an explanatory diagram illustrating progress of cutting of the label tape by rubbing between a first edge portion of a first cutting blade of the rotary body and a second edge portion of a second cutting blade of the holding body.

That is, FIG. 11A is a state in which a portion indicated by an L1-L1 section closer to the left end portion of the first edge portion 621*b* is brought into contact with and rubbed with the second edge portion 631*b* (See a white arrow). For convenience of explanation, a posture (a rotation angle) of the rotary body 620 which realizes this state is assumed to have a rotation phase "0°".

Figure 11B:
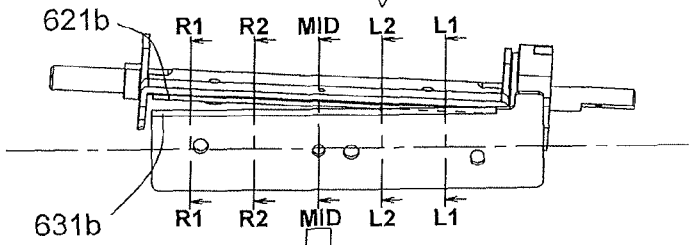
FIG. 11B is an explanatory diagram illustrating progress of cutting of the label tape by rubbing between a first edge portion of a first cutting blade of the rotary body and a second edge portion of a second cutting blade of the holding body.

Subsequently, in FIG. 11B in which rotation of the rotary body 620 progresses, a portion indicated by an L2-L2 section slightly shifted to the right side from the L1-L1 section of the first edge portion 621*b* is brought into contact with and rubbed with the second edge portion 631*b* (See the white arrow). The rotation phase of the rotary body 620 at this time is "4°", for example.

Figure 11C:
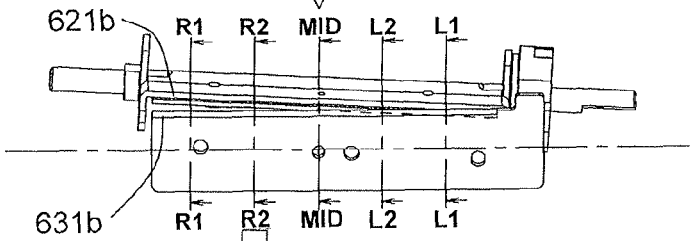
FIG. 11C is an explanatory diagram illustrating progress of cutting of the label tape by rubbing between a first edge portion of a first cutting blade of the rotary body and a second edge portion of a second cutting blade of the holding body.

Subsequently, in FIG. 11C in which the rotation of the rotary body 620 further progresses, a portion indicated by an MID-MID section at a center part in a left and right direction slightly shifted to the right side from the L2-L2 section of the first edge portion 621*b* is brought into contact with and rubbed with the second edge portion 631*b* (See the white arrow). The rotation phase of the rotary body 620 at this time is "8°", for example.

Figure 11D:
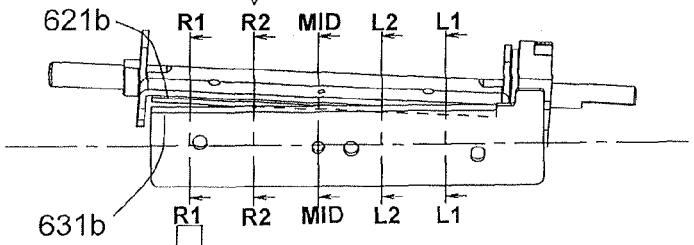
FIG. 11D is an explanatory diagram illustrating progress of cutting of the label tape by rubbing between a first edge portion of a first cutting blade of the rotary body and a second edge portion of a second cutting blade of the holding body.

Subsequently, in FIG. 11D in which the rotation of the rotary body 620 further progresses, a portion indicated by an R2-R2 section slightly shifted to the right side from the MID-MID section of the first edge portion 621*b* is brought into contact with and rubbed with the second edge portion 631*b* (See the white arrow). The rotation phase of the rotary body 620 at this time is "12°", for example.

Figure 11E:
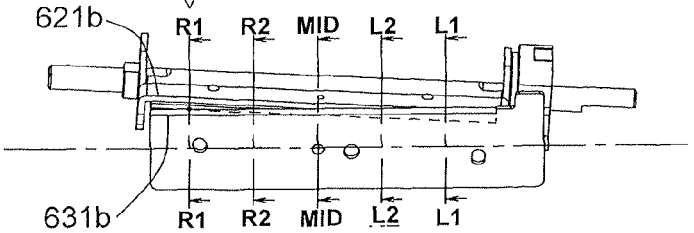
FIG. 11E is an explanatory diagram illustrating progress of cutting of the label tape by rubbing between a first edge portion of a first cutting blade of the rotary body and a second edge portion of a second cutting blade of the holding body.

Subsequently, in FIG. 11E in which the rotation of the rotary body 620 further progresses, a portion indicated by an R1-R1 section close to the right end portion and slightly shifted to the right side from the R2-R2 section of the first edge portion 621*b* is brought into contact with and rubbed with the second edge portion 631*b* (See the white arrow). The rotation phase of the rotary body 620 at this time is "16°", for example.

By introducing the label tape 3A into a contact portion between the first edge portion 621*b* and the second edge portion 631*b* sequentially moving as above, the label tape 3A can be gradually cut forward linearly to the right side after cutting into the label tape 3A is started on the left end portion. At this time, since the aforementioned angle α functions as a shearing angle, cutting can be performed smoothly with a relatively small shearing force.

That is, by using the rotary cutter apparatus 610 having the configuration described above, a cutting mode similar to a usual rotary cutter which makes each portion of a spiral blade disposed on an outer periphery of a cylindrical body portion sequentially cut into an object to be cut and perform linear cutting can be easily realized by the configuration using the two flat blades 621 and 631. As a result, unlike the structure using the spiral blade, the structure can be simplified and a manufacturing process can be also simplified, and moreover, a manufacturing cost can be reduced. At this time, particularly since the label tape 3A is introduced into a portion where a rotation trajectory of the rotary body 620 is brought into contact with the second edge portion 631*b*, smooth cutting can be performed reliably with a small shearing force.

Here, when the portion in the first edge portion 621*b* brought into contact with the second edge portion 631*b* is moved linearly from the left end portion to the right side as described above, since the first edge portion 621*b* of the first flat blade 621 of the rotary body 620 is in parallel with the rotation axis O, a distance between the first edge portion 621*b* and the second edge portion 631*b* slightly fluctuates with the rotation. That is, the entire rotary body 620 has a second rotation trajectory slightly larger than the first rotation trajectory. Thus, particularly in the present embodiment, the holding portion 632 is supported capable of swing by providing the swing support mechanism 635. As a result, fluctuation of the distance is absorbed, and during movement from the left end portion to the right end portion, the first edge portion 621*b* and the second edge portion 631*b* are brought into close contact with each other and rubbed with each other. As a result, cutting can be performed more smoothly.

<Guide when Label Tape is Introduced>

Subsequently, the guide used when the label tape 3A is introduced which is an essential part of the present embodiment will be described by using FIGS. 12A to 12E. As described above, in the present embodiment, by means of rotation of the rotary body 620 along a predetermined rotating direction, the first edge portion 621*b* of the first flat blade 621 is brought closer to the second edge portion 631*b* from one side (from above in this example) along the rotating direction and is further brought into contact with and rubbed with the second edge portion 631*b*. As a result, the label tape 3A fed and introduced into the feeding path passing in a vicinity of the end portion of the second edge portion 631*b* is cut by the first edge portion 621*b* and the second edge portion 631*b* in collaboration.

In the present embodiment, when the label tape 3A is fed through the feeding path and is further fed to the inside of the rotary body 620 from the cutting position, the rotary shaft 650 of the rotary body 620 is brought into contact with the label tape 3A from the one side (the upper side in this example) in the rotating direction and guides the label tape 3A to the other side (the lower side in this example) in the rotating direction.

That is, in the present embodiment, as illustrated in FIGS. 12A to 12E, a size of an outer diameter of the rotary shaft 650 is set so that an outer peripheral surface (particularly a lower surface in this example) of the rotary shaft 650 comes to the substantially equal height as that of the second edge portion 631*b* of the second flat blade 631. Moreover, the rotary shaft 650 is arranged inside a rotation trajectory (See a two-dot chain line) of the first edge portion 621*b*. In FIGS. 12A to 12E, a guide behavior of the label tape 3A by this rotary shaft 650 is illustrated in order along the aforementioned rotation angle (indicating a value of the rotation phase based on the aforementioned rotation phase "0°".

First, FIG. 12A is a state in which the rotation phase of the rotary body 620 is "0°", and the first edge portion 621*b* is brought into contact with and rubbed with the second edge portion 631*b* from the upper side so as to sandwich the label tape 3A having been already guided correctly and in a stable cutting preparation completed state as will be described later. As a result, cutting of the label tape 3A is started. After the cutting is started with the rotation phase "0°" as above, for a period until the rotation phase of approximately "16°" is reached as described above, rubbing between the first edge portion 621*b* and the second edge portion 631*b* is performed, and linear cutting is executed to the label tape 3A.

FIG. 12B is a state of the rotation phase "60°" in which the rotation of the rotary body 620 further slightly progresses from the above state. After the cutting, the label tape 3A on a front in the feeding direction of the cutting position is pushed by a front surface of the first base portion 621*a* and further fed to the front, and the label tape 3A on the rear of the cutting position is also fed to the front and introduced to the inside of the rotation trajectory of the first edge portion 621*b*. A distal end of the label tape 3A protrudes substantially horizontally toward the rotary shaft 650 inside the rotation trajectory.

FIG. 12C is a state of the rotation phase "120°" in which the rotation of the rotary body 620 further slightly progresses. The distal end of the label tape 3A having further progressed from the protruding state reaches and is brought into contact with the rotary shaft 650 and then, is started to be guided (substantially horizontally or slightly downward in this example) so as not to move further upward by the rotary shaft 650. That is, in the present embodiment, the label tape 3A is guided at a rotation position out of a rotation range from the first rotation position to the second rotation position.

FIG. 12D is a state of the rotation phase "180°" in which the rotation of the rotary body 620 further slightly progresses. From this state, the label tape 3A is fed to the front while being further guided by the rotary shaft 650.

FIG. 12E is a state of the rotation phase "270°" in which the rotation of the rotary body 620 further slightly progresses. From this state, the label tape 3A further goes forward while being guided by the rotary shaft 650, and the distal end portion of the label tape 3A is in a state out of the rotation trajectory of the rotary body 620. As a result, the label tape 3A enters the cutting preparation completed state stably held in the feeding path, in which the lower surface is substantially brought into contact with the second edge portion 631*b*, while the upper surface is substantially brought into contact with the lower part of the rotary shaft 650. If the rotation of the rotary body 620 further progresses after this state, the label tape 3A enters a cutting start state illustrated in FIG. 12A, and the similar procedure is repeated.

As described above, in the present embodiment, by means of guiding of the label tape 3A by the rotary shaft 650, the introduced label tape 3A is prevented from erroneously advancing toward the first edge portion 621*b* side of the rotary body 620 and colliding with or interfering with the first edge portion 621*b* before getting closer to the second edge portion 631*b*. As a result, during rubbing between the first edge portion 621*b* and the second edge portion 631*b*, the label tape 3A can be cut stably (See FIG. 12A).

Moreover, particularly in the present embodiment, by using the rotary shaft 650 of the rotary body 620 also as a guide, the object to be cut can be guided without adding a new member.

Not limited to use of the rotary shaft 650 also as a guide as above, a member different from the rotary shaft 650 may be newly provided. Such variations will be described by referring to FIGS. 13A to 13C and 14.

Figure 13A:
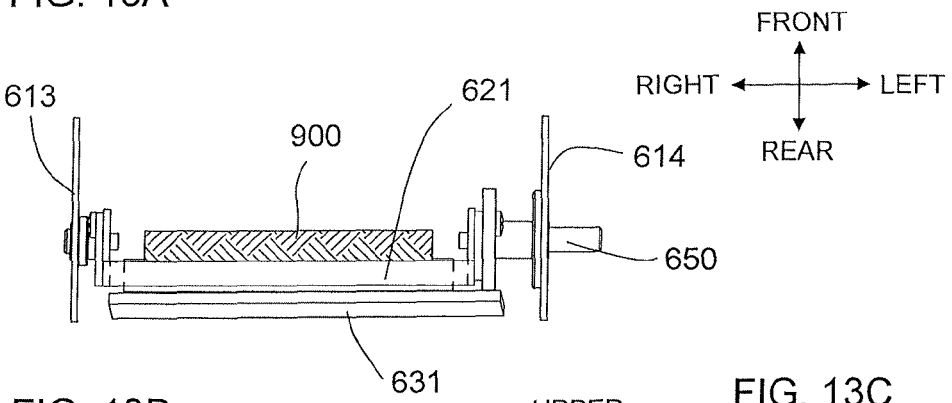
FIG. 13A is a plan view of the rotary cutter apparatus illustrating a variation in which a guide member is separately disposed for guiding the label tape.
Figure 13B:
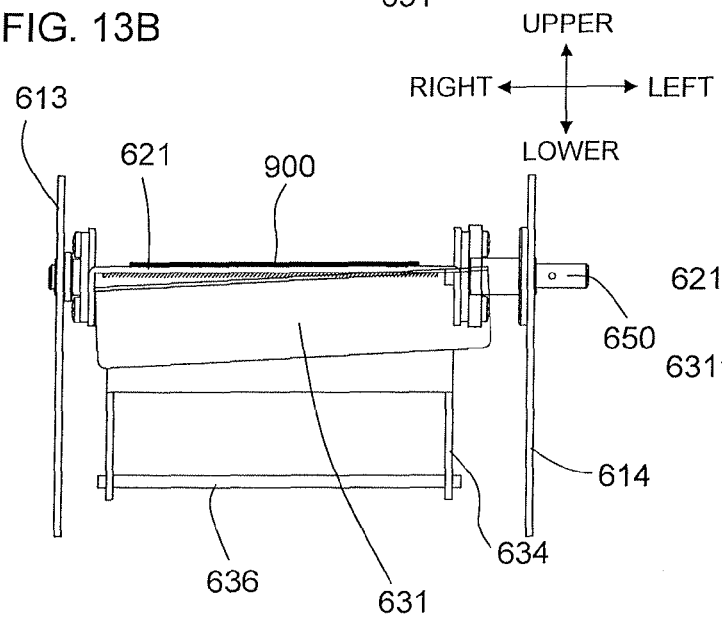
FIG. 13B is a rear view of the rotary cutter apparatus illustrating a variation in which a guide member is separately disposed for guiding the label tape.
Figure 13C:
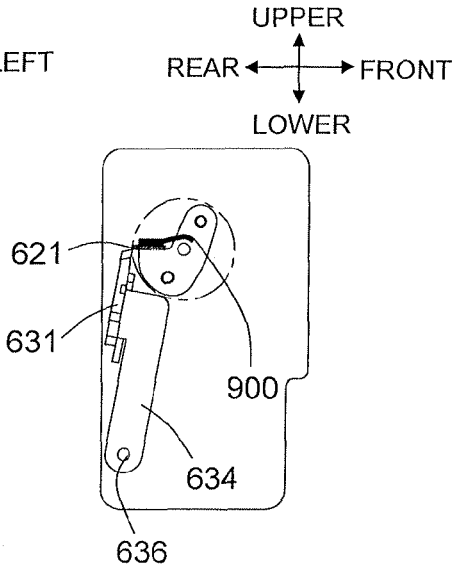
FIG. 13C is a side view of the rotary cutter apparatus illustrating a variation in which a guide member is separately disposed for guiding the label tape.

As illustrated in FIGS. 13A to 13C, in this variation, a guide member 900 having a downwardly curved section is provided on the back surface of the first flat blade 621 of the rotary body 620 so as to protrude to the side opposite to the first edge portion 621*b*, that is, toward the rotation axis O side. The guide member 900 is brought into contact with the label tape 3A from the one side (upper side in this example) in the rotating direction and guides the label tape 3A to the other side (lower side in this example) in the rotating direction when the label tape 3A is fed on the feeding path and further fed from the cutting position to the inside of the rotary body 620 similarly to the above. Moreover, the guide member 900 is arranged inside the rotation trajectory (see the two-dot chain line) of the first edge portion 621*b*. In this variation, a center part in the axial direction (that is, the right-and-left direction) of the rotary shaft 650 is removed in order to install the guide member 900.

In FIGS. 14A to 14E, similarly to FIGS. 12A to 12E, the guide behavior of the label tape 3A by the guide member 900 is illustrated in order along the aforementioned rotation angle. First, FIG. 14A is a state in which the rotation phase of the rotary body 620 is "0°", and similarly to the above, the first edge portion 621*b* is brought into contact with and rubbed with the second edge portion 631*b* from the upper side, and cutting of the label tape 3A is started.

FIG. 14B is a state of the rotation phase "60°" in which the rotation the rotary body 620 further slightly progresses from the above state. After the cutting, the label tape 3A on the front in the feeding direction of the cutting position is pushed by the front surface of the first base portion 621*a* and further fed to the front, and the label tape 3A on the rear of the cutting position is also fed to the front and introduced to the inside of the rotation trajectory of the first edge portion 621*b*. The distal end of the label tape 3A protrudes substantially horizontally toward the guide member 900 inside the rotation trajectory.

FIG. 14C is a state of the rotation phase "120°" in which the rotation of the rotary body 620 further slightly progresses. The distal end of the label tape 3A having further progressed from the protruding state reaches and is brought into contact with the guide member 900 and then, is started to be guided (slightly downward in this example) so as not to move further upward by the guide member 900.

FIG. 14D is a state of the rotation phase "180°" in which the rotation of the rotary body 620 further slightly progresses. From this state, the label tape 3A is fed to the front while being further guided by the guide member 900.

FIG. 14E is a state of the rotation phase "270°" in which the rotation of the rotary body 620 further slightly progresses. From this state, the label tape 3A further goes forward while being guided by the guide member 900, and the distal end portion of the label tape 3A is in a state out of the rotation trajectory of the rotary body 620. As a result, the label tape 3A is substantially brought into contact with the second edge portion 631*b* on the lower surface and enters the cutting preparation completed state in which the upper surface is located below the guide member 900 and stably held in the feeding path. If the rotation of the rotary body 620 further progresses after this state, the label tape 3A enters a cutting start state illustrated in FIG. 14A, and the similar procedure is repeated.

In the present variation, too, the same advantages as those of the aforementioned embodiment are obtained. Particularly, by guiding the label tape by providing the guide member 900 on the rotary body 620, effective guide using the rotary motion can be performed for the label tape 3A. For example, the rotation position where the guiding is started, the rotation position where the guiding is finished and the like can be freely set, and a guiding mode can be finely adjusted.

In the above, the example in which the present disclosure is applied to the rotary cutter apparatus 610 in which the planar direction of the second base portion 631*a* of the second flat blade 631 is made parallel with the rotation axis O at a predetermined interval, and the straight line including the second edge portion 631*b* and the rotation axis O are disposed forming the predetermined angle α when seen from the side surface direction orthogonal to the planar direction of the second base portion 631*a* is explained, but this is not limiting. That is, the present disclosure may be applied to the rotary cutter apparatus in which the rotary body has the flat blade mounting portion arranged at a position away from the rotation axis on the plane crossing the rotation axis and arranged with inclination with respect to the rotation axis so that the radial dimension of the rotation trajectory by the end portion on the one side is larger than the radial dimension of the rotation trajectory by the end portion on the other side and the flat blade supporting portion supporting the first flat blade with respect to the flat blade mounting portion so that the end portion on the one side and the end portion on the other side of the first flat blade form the rotation trajectories having the same diameter by disposing the end portion on the other side of the first flat blade corresponding to the other side of the flat blade mounting portion so as to protrude more largely in the circumferential direction than the end portion on the one side of the first flat blade corresponding to the one side of the flat blade mounting portion, and the holding body is provided with a holding portion capable of holding the second flat blade so as to be substantially parallel with the rotation axis at the predetermined interval.

In the rotary cutter apparatus having the aforementioned configuration, too, the end portion on the one side of the first flat blade and the end portion on the other side of the first flat blade form rotation trajectories having the same diameter and as a result, the first flat blade of the rotary body rotates for the whole area from the one side to the other side by keeping the substantially same distance from the rotation axis. Therefore, by introducing the object to be cut at the position away only by the predetermined distance which is the same from the rotation axis, substantially linear cutting can be applied to the object to be cut for the whole area from the one side to the other side of the first flat blade. In such rotary cutter apparatus, the same advantages as those of the above can be obtained by disposing the guide member 900 and the like.

Moreover, not limited to the rotary cutter apparatus using the flat blade as above, the guide member 900 and the like may be arranged in an ordinary rotary cutter performing linear cutting by sequentially having each part of a spiral blade disposed on an outer periphery of a cylindrical body portion cut into the object to be cut. In this case, too, the same advantages as those of the above can be obtained.

In the above, the print label T was produced by applying a print on the label tape 3A and cutting the same, but this is not limiting. That is, the present disclosure may be applied to a type in which a print is applied to a print-receiving tape and then, the tape is bonded with a base tape, and the bonded tape is cut so as to produce a print label T (so-called laminate type). In this case, too, the same advantages as those of the above can be obtained.

Moreover, other than those described above, methods in the aforementioned embodiment and each of the variations may be used in combination as appropriate.

What is claimed is:

1. A rotary cutter apparatus comprising:

a housing;

a rotary body supported by said housing so as to rotate along a predetermined rotating direction around a rotation axis; and a holding body supported to swing relative to said housing, said rotary body having a rotary blade including a first edge portion;

said holding body having a fixed blade including a second edge portion;

said first edge portion being configured to be in contact with said second edge portion in said rotating direction and to be rubbed with the second edge portion;

said first edge portion and said second edge portion being configured to perform cutting of an object to be cut by said rubbing, the object being located in an introduction path passing in a vicinity of an end portion of said second edge portion; and said rotary cutter apparatus further comprising a guide member configured to be in contact with said object to be cut and to guide the object when the object is fed from a cutting position to an inside of a rotation trajectory of said rotary body in said introduction path; wherein said rotary blade is a first flat blade including said first edge portion having a linear shape, said fixed blade is a second flat blade including said second edge portion having a linear shape, said second flat blade includes a substantially plate-shaped second base portion, said rotary body has a rotation-side supporting portion provided on said housing so as to rotate around said rotation axis and configured to support said first flat blade so that said first edge portion is parallel with said rotation axis, and said holding body has a fixed-side holding portion configured to hold said second flat blade so that a surface of said second base portion of said second flat blade is parallel with said rotation axis, and when seen from a direction orthogonal to the surface of said second base portion of said second flat blade, said rotation axis and a straight line including said second edge portion are arranged by forming a predetermined angle, said guide member is a rotary shaft arranged in said rotary body and located at said rotation axis, and said rotary shaft has an outer diameter dimension so that a position of a lowest part of the rotatory shaft in a height direction orthogonal to a feeding surface of said object to be cut is substantially the same as a position of said second edge portion in said height direction.

2. The rotary cutter apparatus according to claim 1, wherein:

said first edge portion of said first flat blade is configured to perform said cutting by rubbing with said second edge portion in a rotation range from a first rotation position in said rotating direction to a second rotation position to which rotation has progressed from the first rotation position in accordance with the rotation of said rotary body; and said rotary shaft is arranged inside the rotation trajectory of said first edge portion and is configured to be in contact with said object to be cut and to guide the object when said rotary body is at a rotation position out of said rotation range where cutting by said rubbing is not performed.

3. The rotary cutter apparatus according to claim 1, wherein:

said fixed-side holding portion has:

a plate-shaped holding portion on which said second flat blade is mounted;

two extended portions provided to both end portions of said plate-shaped holding portion;

a support shaft connecting said two extended portions and provided so as to rotate with respect to said housing; and an urging member configured to provide an urging force in a direction toward said rotary body to said plate-shaped holding portion made rotatable around an axis of said support shaft by said two extended portions.

4. The rotary cutter apparatus according to claim 1, wherein:

said first flat blade is supported by said rotation-side supporting portion so that a surface of the first flat blade on said second side in said rotating direction pushes out a rear end portion of a cut object in a feeding direction to a front in said feeding direction with rotation of said rotary body, the cut object created by cutting of said object to be cut.

5. A rotary cutter apparatus comprising:

a housing;

a rotary body supported by said housing so as to rotate along a predetermined rotating direction around a rotation axis; and a holding body supported by said housing, said rotary body having a rotary blade including a first edge portion;

said holding body having a fixed blade including a second edge portion;

said first edge portion being configured to be in contact with said second edge portion from a first side in said rotating direction and to be rubbed with the second edge portion;

said first edge portion and said second edge portion being configured to perform cutting of an object to be cut by said rubbing, the object being located in an introduction path passing in a vicinity of an end portion of said second edge portion; and said rotary cutter apparatus further comprising a guide member configured to be in contact with said object to be cut from said first side in said rotating direction and to guide the object to a second side in said rotating direction when the object is fed from a cutting position to an inside of a rotation trajectory of said rotary body in said introduction path;

said rotary blade is a first flat blade including said first edge portion having a linear shape, said fixed blade is a second flat blade including said second edge portion having a linear shape, said rotary body has a rotation-side supporting portion provided on said housing so as to rotate around said rotation axis and configured to support said first flat blade so that said first edge portion is parallel with said rotation axis, and said holding body has a fixed-side holding portion configured to hold said second flat blade so that a surface of said second flat blade is parallel with said rotation axis, and when seen from a direction orthogonal to the surface of said second flat blade, a straight line including said second edge portion and said rotation axis are arranged by forming a predetermined angle, wherein:

said guide member is a member that has a downwardly curved section and is provided to said rotary blade of said rotary body so as to protrude to a side opposite to said first edge portion.

6. A rotary cutter apparatus comprising:

a first wall and a second wall facing to each other at a predetermined interval;

a rotary body that has a rotary shaft passing through said first wall and said second wall and is configured to rotate along a predetermined rotating direction; and a holding body that is supported by said first wall and said second wall, said rotary body having:

a first bracket disposed to a first end of said rotary shaft;

a second bracket disposed to a second end of said rotary shaft; and a rectangular connecting plate that is arranged parallel to said rotary shaft and that connects said first bracket with said second bracket;

said rectangular connecting plate having:

a first surface configured to precede in a rotating direction of said rotary shaft; and a second surface configured to come after said first surface in said rotating direction of said rotatory shaft;

said rotary body further having a first flat blade that includes a first edge portion and is disposed on said first surface of said rectangular connecting plate, said holding body having a second flat blade including a second edge portion, said first edge portion being configured to be in contact with said second edge portion from a first side in said rotating direction and to be rubbed with the second edge portion, said first edge portion and said second edge portion being configured to perform cutting of an object to be cut by said rubbing, the object being located in an introduction path passing in a vicinity of an end portion of said second edge portion, and said rotary shaft being configured to be in contact with said object to be cut from said first side in said rotating direction and to guide the object to a second side in said rotating direction when the object is fed from a cutting position to an inside of a rotation trajectory of said rotary body in said introduction path.

7. A rotary cutter apparatus comprising:

a first wall and a second wall facing to each other at a predetermined interval;

a rotary body that has a rotary shaft passing through said second wall and is configured to rotate along a predetermined rotating direction; and a holding body that supports said first wall and said second wall, said rotary body having:

a first bracket disposed to a first end of said rotary shaft;

a second bracket disposed between said first wall and said first bracket; and a rectangular connecting plate that is arranged parallel to said rotary shaft and that connects said first bracket with said second bracket;

said rectangular connecting plate having:

a first surface configured to precede in a rotating direction of said rotary shaft; and a second surface configured to come after said first surface in said rotating direction of said rotary shaft;

said rotary body further having a first flat blade that includes a first edge portion and is disposed on said first surface of said rectangular connecting plate, said holding body having a second flat blade including a second edge portion, said first edge portion being configured to be in contact with said second edge portion from a first side in said rotating direction and to be rubbed with the second edge portion, said first edge portion and said second edge portion being configured to perform cutting of an object to be cut by said rubbing, the object being located in an introduction path passing in a vicinity of an end portion of said second edge portion, said rotary cutter apparatus further comprising a guide member that covers said rotary shaft and is disposed on at least a part of said second surface of said connecting plate, and said guide member having a downwardly curved section.

8. The rotary cutter apparatus according to claim 7, wherein said guide member is a plate curving opposite to said rotating direction.

* * * * *